United States Patent [19]

Wazaki et al.

[11] Patent Number: 4,589,390

[45] Date of Patent: May 20, 1986

[54] AIR-FUEL RATIO FEEDBACK CONTROL METHOD FOR INTERNAL COMBUSTION ENGINES

[75] Inventors: Yoshio Wazaki; Akihiko Koike; Yuzuru Koike, all of Utsunomiya, Japan

[73] Assignee: Honda Giken Kogyo K.K., Tokyo, Japan

[21] Appl. No.: 729,367

[22] Filed: May 1, 1985

[30] Foreign Application Priority Data

May 2, 1984 [JP] Japan ..... 59-88884

[51] Int. Cl.[4] ..... F02M 51/00

[52] U.S. Cl. ..... 123/339; 123/489; 123/480; 123/440

[58] Field of Search ..... 123/339, 480, 440, 493, 123/489, 438, 486

[56] References Cited

U.S. PATENT DOCUMENTS

| | | | |
|---|---|---|---|
| 4,345,557 | 8/1982 | Ikeura | 123/339 |
| 4,406,262 | 9/1983 | Ikeura | 123/339 |
| 4,457,276 | 7/1984 | Ueda et al. | 123/339 |
| 4,508,075 | 4/1985 | Takao et al. | 123/489 |
| 4,517,948 | 5/1985 | Kaji et al. | 123/489 |
| 4,539,967 | 9/1985 | Nakajima et al. | 123/339 |
| 4,542,729 | 9/1985 | Yamato et al. | 123/489 |

*Primary Examiner*—Raymond A. Nelli

*Attorney, Agent, or Firm*—Arthur L. Lessler

[57] ABSTRACT

A method of effecting feedback control of the air-fuel ratio of an air-fuel mixture being supplied to an internal combustion engine, by correcting a basic fuel supply quantity by the use of a coefficient variable in value in response to the output of an exhaust gas ingredient concentration detecting means, while the engine is operating in a predetermined air-fuel ratio feedback control effecting region. The predetermined air-fuel ratio feedback control effecting region is previously divided into at least first and second subdivided regions. A first mean value of the coefficient is calculated and stored when the engine is operating in the first subdivided region, and a second mean value of same when the engine is operating in the second subdivided region, respectively. The first mean value is used as an initial value of the coefficient, when the engine operation has entered the first subdivided region, and the second mean value when it has entered the second subdivided region, respectively.

2 Claims, 6 Drawing Figures

FUEL INJECTION VALVES
6
INTERNAL COMBUSTION ENGINE
1
THREE-WAY CATALYST
14
13
O2 SENSOR
15
CYL SENSOR
12
Ne SENSOR
11
Tw SENSOR
10
TA SENSOR
9
PBA SENSOR
8
7
2
θTH SENSOR
4
3
PA SENSOR
16
STARTER SWITCH
17
BATTERY
18
ECU
5

AIR-FUEL RATIO FEEDBACK CONTROL METHOD FOR INTERNAL COMBUSTION ENGINES

BACKGROUND OF THE INVENTION

This invention relates to a feedback control method of controlling the air-fuel ratio of an air-fuel mixture being supplied to an internal combustion engine, and more particularly to a method of this kind, which is applied when it is detected that the engine has entered a feedback control effecting region.

A fuel supply control method for an internal combustion engine, particularly a gasoline engine, has been proposed, e.g. by U.S. Pat. No. 4,445,482 issued May 1, 1984, which is adapted to determine the valve opening period of a fuel injectin device for control of the fuel injection quantity, i.e. the air-fuel ratio of an air-fuel mixture being supplied to the engine, by first determining a basic value of the above valve opening period as a function of engine speed and intake pipe absolute pressure and then adding to and/or multiplying same by variables and/or coefficients indicative of operating conditions of the engine, such as engine speed, intake pipe absolute pressure, engine temperature, throttle valve opening, exhaust gas ingredient concentration (oxygen concentation), etc., by electronic computing means.

According to this proposed method, while the engine is operating in a normal operating condition, the air-fuel ratio is controlled in closed loop or feedback mode such that the valve opening period of the fuel injection device is controlled by varying the value of a coefficient in response to the output of an exhaust gas ingredient concentration detecting means which is arranged in the exhaust system of the engine, so as to attain a theoretical air/fuel ratio or a value close thereto (closed loop control), whereas while the engine is operating in one of particular operating conditions (e.g. a mixture-leaning region, a wide-open-throttle region, and a fuel-cut effecting region), the air-fuel ratio is controlled in open loop mode by the use of a mean value of values of the above coefficient applied during the preceding feedback control, together with an exclusive coefficient corresponding to the kind of the particular operating region in which the engine is then operating, thereby preventing deviation of the air-fuel ratio from a desired air-fuel ratio due to variations in the performance of various engine operating condition sensors and a system for controlling or driving the fuel injection device, etc., which are caused by machining tolerances or the like and/or due to aging changes in the performance of the sensors and the system, and also achieving required air-fuel ratios best suited for the respective particular operating conditions, to thus reduce the fuel consumption as well as improve the driveability of the engine.

However, according to this method, the mean value of values of the above coefficient which have been applied during the preceding feedback control assumes a different value each time it is calculated and stored at each different operating point of the engine within the region wherein feedback control should be effected. As a result, in the case that the feedback control effecting region is previously divided into a plurality of subdivided regions, when the engine operating point shifts from one of the subdivided regions to another one, there exists a time lag, i.e. a feedback control lag before the above feedback control correction coefficient assumes a value appropriate for attaining desired emission characteristics for the another subdivided region during the feedback control. Therefore, if the method is applied to an internal combustion engine having an exhaust gas purifying device, such as a three-way catalyst, until a period of time corresponding to the above time lag elapses, the amount of an exhaust gas ingredient NOx can increase if the air-fuel ratio varies from a leaner value to an appropriate value for attaining the desired emission characteristics, whereas the amounts of ingredients CO, UHC, etc. in the exhaust gases can increase if the air-fuel ratio varies from a richer value to the same appropriate value.

SUMMARY OF THE INVENTION

It is the object of the invention to provide an air-fuel ratio feedback control method for an internal combustion engine, which is applied when the engine operation enters one of a plurality of subdivided regions of the feedback control effecting region, and which is adapted to set the air-fuel ratio of the air-fuel mixture to a value best suited to the subdivided region, with a minimum time lag, to thereby positively reduce noxious ingredients in the exhaust gases such as NOx, CO, and UHC.

The present invention provides a method of effecting feedback control of the air-fuel ratio of an air-fuel mixture being supplied to an internal combustion engine having an exhaust pipe and an exhaust gas ingredient concentration detecting means arranged in the exhaust pipe, by correcting a basic fuel supply quantity by the use of a coefficient variable in value in response to the output of the exhaust gas ingredient concentration detecting means, while the engine is operating in a predetermined air-fuel ratio feedback control effecting region. The method is characterized by comprising the steps of: (1) previously dividing the predetermined air-fuel ratio feedback control effecting region into at least first and second subdivided regions; (2) determining whether or not the engine is operating in one of the first and second subdivided regions; (3) calculating and storing a first mean value of values of the coefficient which have been applied in the feedback control effected when the engine is operating in the first subdivided region, while calculating and storing a second mean value of values of the coefficient which have been applied in the feedback control effected when the engine is operating in the second subdivided region; (4) initiating the air-fuel ratio feedback control by using the first mean value as an initial value of the coefficient, when it is detected that the operation of the engine has entered the first subdivided region; and (5) initiating the air-fuel ratio feedback control by using the second mean value as an initial value of the coefficient, when it is detected that the operation of the engine has entered the second subdivided region.

Preferably, one of the first and second subdivided regions is an idling region of the engine.

The above and other objects, features and advantages of the invention will be more apparent from the ensuing detailed description taken in conjunction with the accompanying drawings.

DETAILED DESCRIPTION

The invention will now be described in detail with reference to the drawings.

Figure 1:
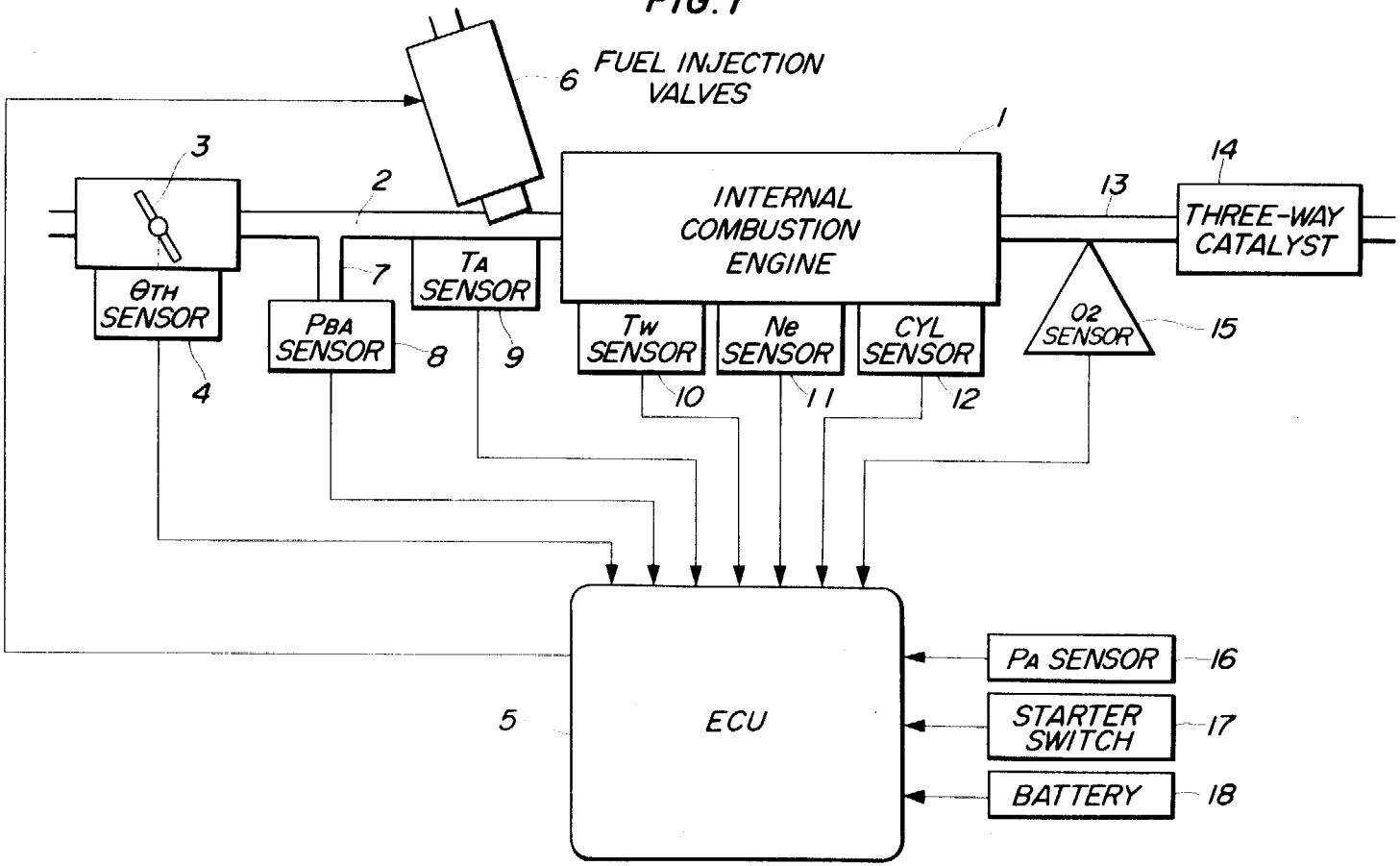
FIG. 1 is a block diagram illustrating the whole arrangement of a fuel supply control system to which is applicable the method according to the invention.

Referring first to FIG. 1, there is illustrated the whole arrangement of a fuel supply control system for internal combustion engines, to which the method of the invention is applicable. Reference numeral 1 designates an internal combustion engine which may be a four-cylinder type, for instance. An intake pipe 2 is connected to the engine 1, in which is arranged a throttle valve 3, which in turn is coupled a throttle valve opening ($\theta$TH) sensor 4 for detecting its valve opening and converting same into an electrical signal which is supplied to an electronic control unit (hereinafter called "the ECU") 5.

Fuel injection valves 6 are arranged in the intake pipe 2 at a location between the engine 1 and the throttle valve 3, which correspond in number to the engine cylinders and are each arranged at a location slightly upstream of an intake valve, not shown, of a corresponding engine cylinder. These injection valves 6 are connected to a fuel pump, not shown, and also electrically connected to the ECU 5 in a manner having their valve opening periods or fuel injection quantities controlled by signals supplied from the ECU 5.

On the other hand, an absolute pressure (PBA) sensor 8 is arranged in communication through a conduit 7 with the interior of the intake pipe 2 at a location downstream of the throttle valve 3. The absolute pressure (PBA) sensor 8 is adapted to detect absolute pressure in the intake pipe 2 and applies an electrical signal indicative of detected absolute pressure to the ECU 5. An intake air temperature (TA) sensor 9 is arranged in the intake pipe 2 at a location downstream of the absolute pressure (PBA) sensor 8 and also electrically connected to the ECU 5 for supplying thereto an electrical signal indicative of detected intake air temperature.

An engine temperature (TW) sensor 10, which may be formed of a thermistor or the like, is mounted on the main body of the engine 1, of which an electrical output signal indicative of detected engine cooling water temperature is supplied to the ECU 5.

An engine rotational angle position (Ne) sensor 11 and a cylinder-discriminating (CYL) sensor 12 are arranged in facing relation to a camshaft, not shown, of the engine 1 or a crankshaft of same, not shown. The former 11 is adapted to generate one pulse at each of particular crank angles of the engine each time the engine crankshaft rotates through 180 degrees, i.e. upon generation of each pulse of a top-dead-center position (TDC) signal, while the latter 12 is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO, NOx, etc. contained in the exhaust gases. An exhaust gas ingredient concentration detecting means such as an $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starter switch 17 for actuating the engine starter, not shown, of the engine 1, respectively, for supplying an electrical signal indicative of detected atmospheric pressure and an electrical signal indicative of its own on and off positions to the ECU 5.

Further electrically connected to the ECU 5 is a battery 18 which supplies the ECU 5 with a supply voltage for operating same.

The ECU 5 operates in response to various engine operation parameter signals as stated above, to determine operating conditions in which the engine is operating, such as a predetermined air-fuel ratio feedback control effecting region, and to calculate the fuel injection period TOUT for which the fuel injection valves 6 should be opened, in accordance with the determined operating conditions of the engine and in synchronism with generation of pulses of the TDC signal, by the use of the following equation:

$$TOUT = Ti \times (KTA \times KTW \times KWOT \times KLS \times KDR \times KCAT \times KO) + TV \quad (1)$$

where Ti represents a basic value of the valve opening period or fuel injection period of the fuel injection valves 6, which is determined as a function of engine speed Ne and intake pipe absolute pressure PBA, and KTA an intake air temperature-dependent correction coefficient and KTW an engine temperature-dependent correction coefficient, which have their values determined by intake air temperature TA and engine cooling water temperature TW, respectively. KWOT, KLS and KDR are correction coefficients, of which KWOT is a mixture-enriching coefficient applicable at wide-open-throttle operation, KLS a mixture-leaning coefficient applicable at mixture-leaning operation, and KDR a mixture-enriching coefficient applicable at operation of the engine in a low engine speed open loop control region which the engine passes while it is being rapidly accelerated from an idling region, for the purpose of improving the driveability of the engine in such operating condition. KCAT is a mixture-enriching coefficient applicable at engine operation in a high engine speed open loop control region, for the purpose of preventing burning of the three-way catalyst 14 in FIG. 1. This coefficient KCAT is set to larger values as the engine load increases. $KO_2$ represents an $O_2$ sensor output-dependent correction coefficient, the value of which is determined in response to the oxygen concentration in the exhaust gases during engine operation in the feedback control effecting region, in a manner shown in FIG. 3. On the other hand, this correction coefficient $KO_2$ has its value set to and held at respective predetermined values during engine operation in other or particular operating conditions wherein the feedback control is not effected. TV represents a correction variable, which has its value determined in response to the output voltage from the battery 18.

The ECU 5 operates on the value of the fuel injection period TOUT determined as above to supply corresponding driving signals to the fuel injection valves 6.

Figure 2:
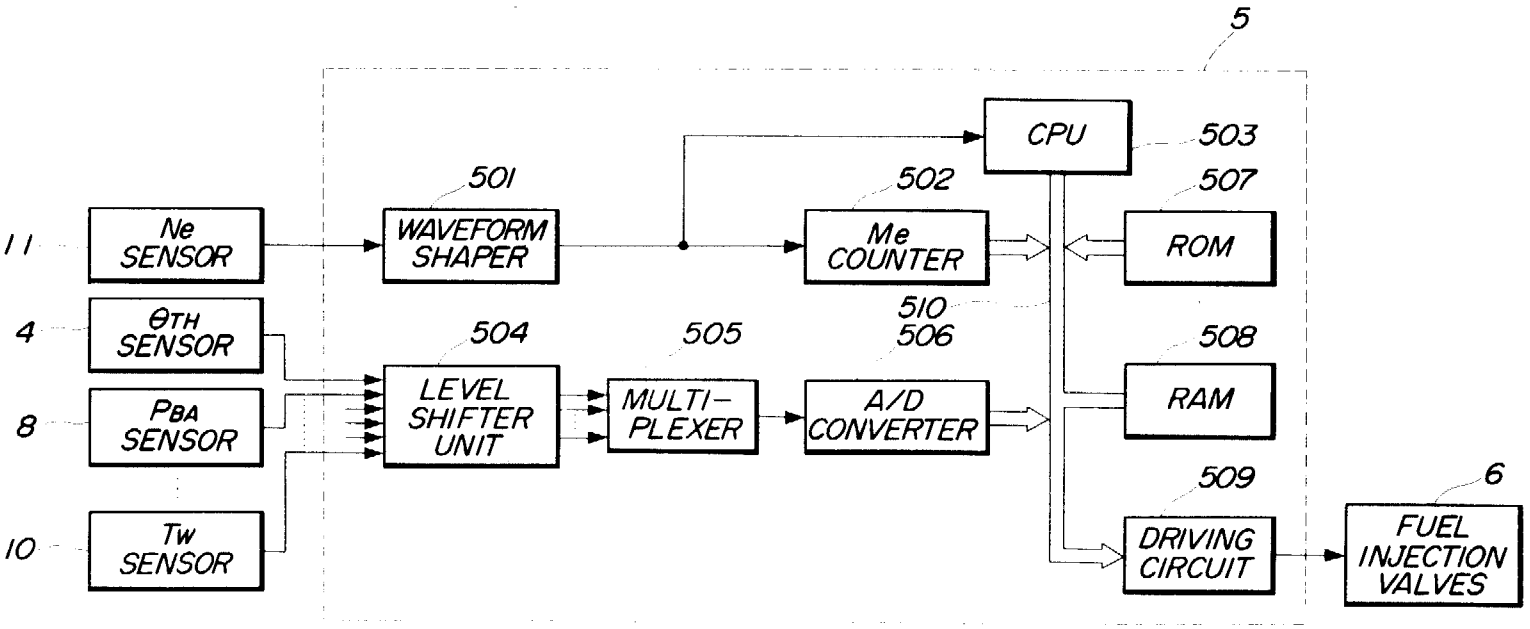
FIG. 2 is a block diagram illustrating the internal arrangement of an electronic control unit (ECU) appearing in FIG. 1.

FIG. 2 shows a circuit configuration within the ECU 5 in FIG. 1. An output signal from the engine rotational angle position (Ne) sensor 11 is applied to a waveform shaper 501, wherein it has its pulse waveform shaped, and supplied to a central processing unit (hereinafter called "the CPU") 503, as the TDC signal, as well as to an Me value counter 502. The Me value counter 502 counts the interval of time between a preceding pulse of the TDC signal generated at a predetermined crank angle of the engine and a present pulse of the same signal generated at the same crank angle, inputted thereto from the engine rotational angle position (Ne) sensor 11, and therefore its counted value Me is proportional to the reciprocal of the actual engine speed Ne. The Me value counter 502 supplies the counted value Me to the CPU 503 via a data bus 510.

The respective output signals from the throttle valve opening ($\theta$TH) sensor 4, the intake pipe absolute pressure (PBA) sensor 8, the engine coolant temperature (TW) sensor 10, etc. have their voltage levels shifted to a predetermined voltage level by a level shifter unit 504 and then successively applied to an analog-to-digital converter 506 through a multiplexer 505.

The analog-to-digital converter 506 successively converts into digital signals analog output voltages from the aforementioned various sensors, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508 and a driving circuit 509. The RAM 508 temporarily stores various calculated values from the CPU 503, while the ROM 507 stores a control program executed within the CPU 503, a map of the basic fuel injection period Ti for the fuel injection valves 6, which has its values read in dependence on intake pipe absolute pressure and engine speed, correction coefficient maps, etc.

The CPU 503 executes the control program stored in the ROM 507 to calculate the fuel injection period TOUT for the fuel injection valves 6 in response to the various engine operation parameter signals and the parameter signals for correction of the fuel injection period, and supplies the calculated value of fuel injection period to the driving circuit 509 through the data bus 510. The driving circuit 509 supplies driving signals corresponding to the above calculated TOUT value to the fuel injection valves 6 to drive same.

Figure 3:
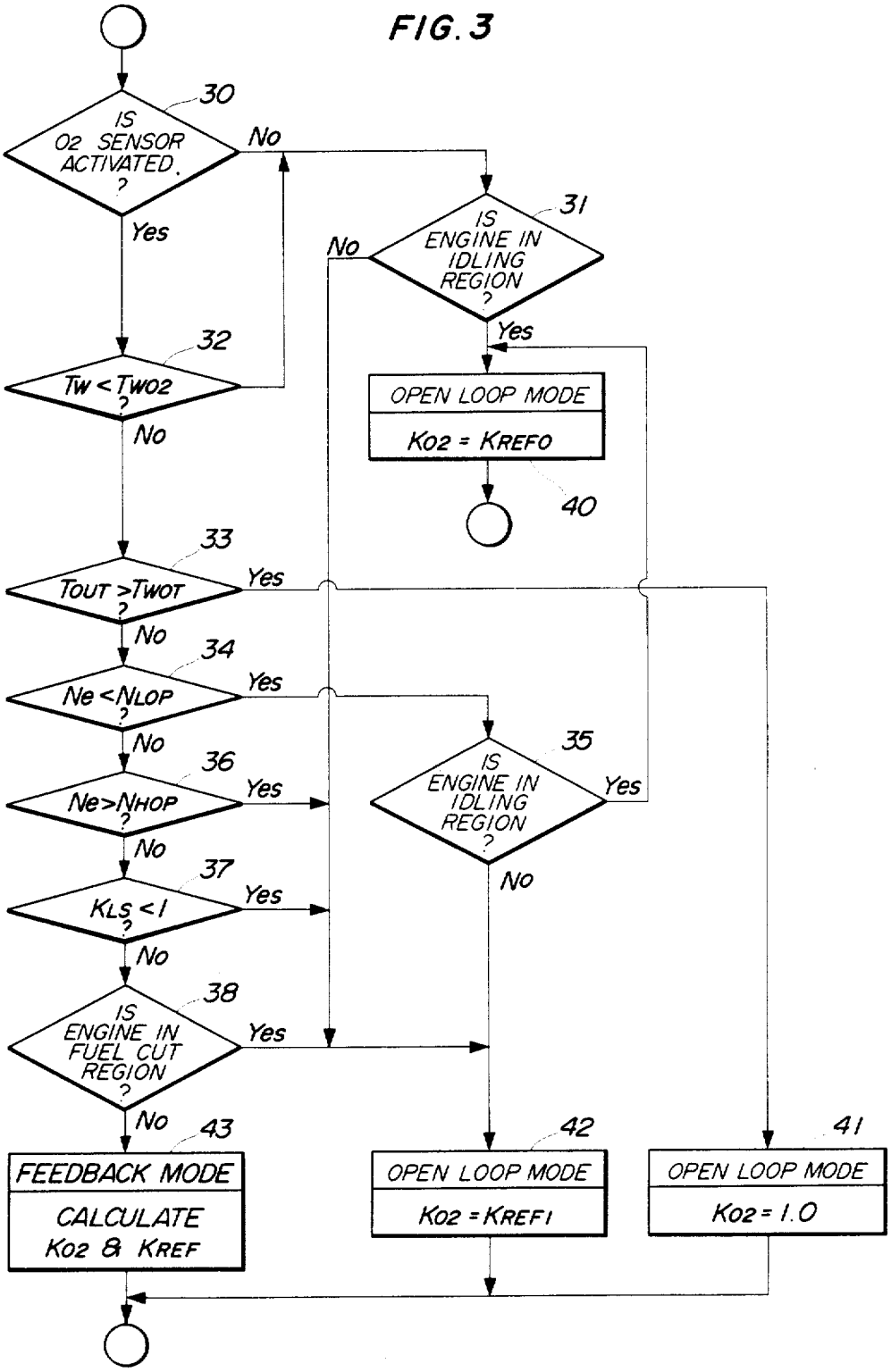
FIG. 3 is a flowchart of a manner of executing the method according to the invention.

Referring next to FIG. 3, there is shown a flowchart of a program for carrying out the method according to the invention. This program is executed upon generation of each pulse of the TDC signal. First, at the step 30, it is determined whether or not the $O_2$ sensor 15 has become activated. If the answer to the question at the step 30 is no, that is, when the $O_2$ sensor 15 has not yet become activated, it is determined, at the step 31, whether or not the engine is operating in the idling region which is indicated by the symbol I in FIG. 4.

Figure 4:
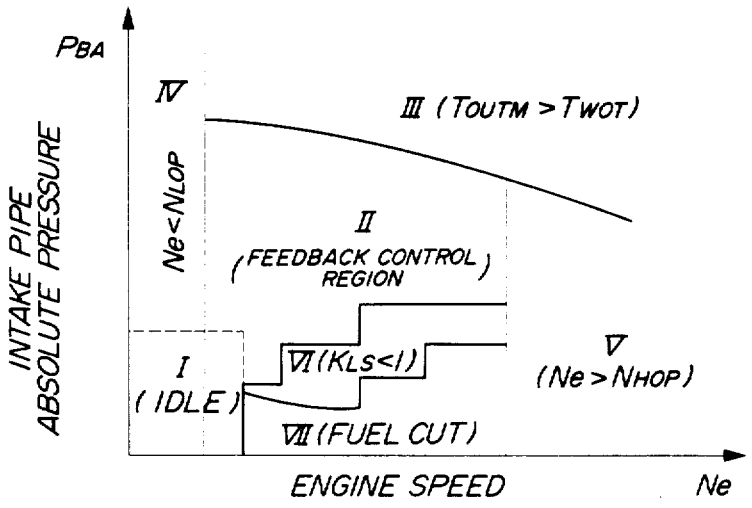
FIG. 4 is a graph showing various operating regions of the engine.
Figure 5:
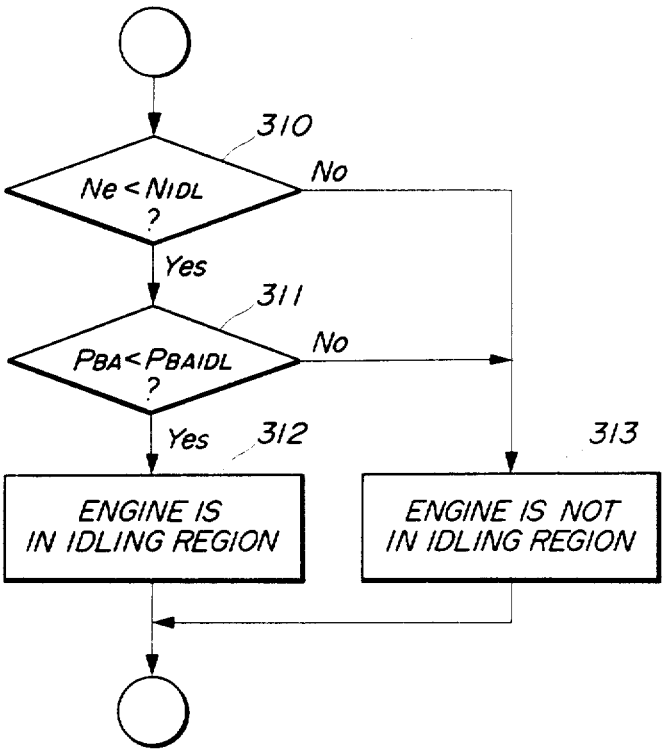
FIG. 5 is a flowchart of a subroutine for determining an idling region of the engine.

The determination as to whether or not the engine is operating in the idling region is effected, e.g. in a manner as shown in FIG. 5: It is first determined, at the step 310, whether or not the engine rotational speed Ne is lower than an idling speed NIDL, e.g. 1000 rpm, and if the answer is yes, a determination is made as to whether or not the intake pipe absolute pressure PBA is lower than a value PBAIDL, e.g. 350 mmHg, which is assumed when the engine is operating in the idling region, at the step 311. If the answer to the question at the step 311 is yes, the engine is determined to be operating in the idling region indicated by the symbol I in FIG. 4, at the step 312. If either of the determinations at the steps 310 and 311 provides a negative answer (no), the engine is determined to be operating in a region other than the idling region, at the step 313.

Reverting to FIG. 3, if the answer to the question at the step 31 is yes, that is, when the engine is operating in the idling region while at the same time the $O_2$ sensor 15 has not yet become activated, the correction coefficient $KO_2$ has its value set to a mean value KREF0, which has been calculated during the preceding feedback control effected while the engine was operating in the idling region, in a manner hereinafter described in detail with reference to FIG. 6, at the step 40. The correction coefficient $KO_2$ with its value set to the mean value of the correction coefficient $KO_2$ KREF0 at the step 40 is applied to open loop control of the air-fuel ratio in the idling region. The same mean value KREF0 is also employed as an initial value of the correction coefficient $KO_2$ at the start of feedback mode control in the idling region immediately following engine operation in another region.

Figure 6:
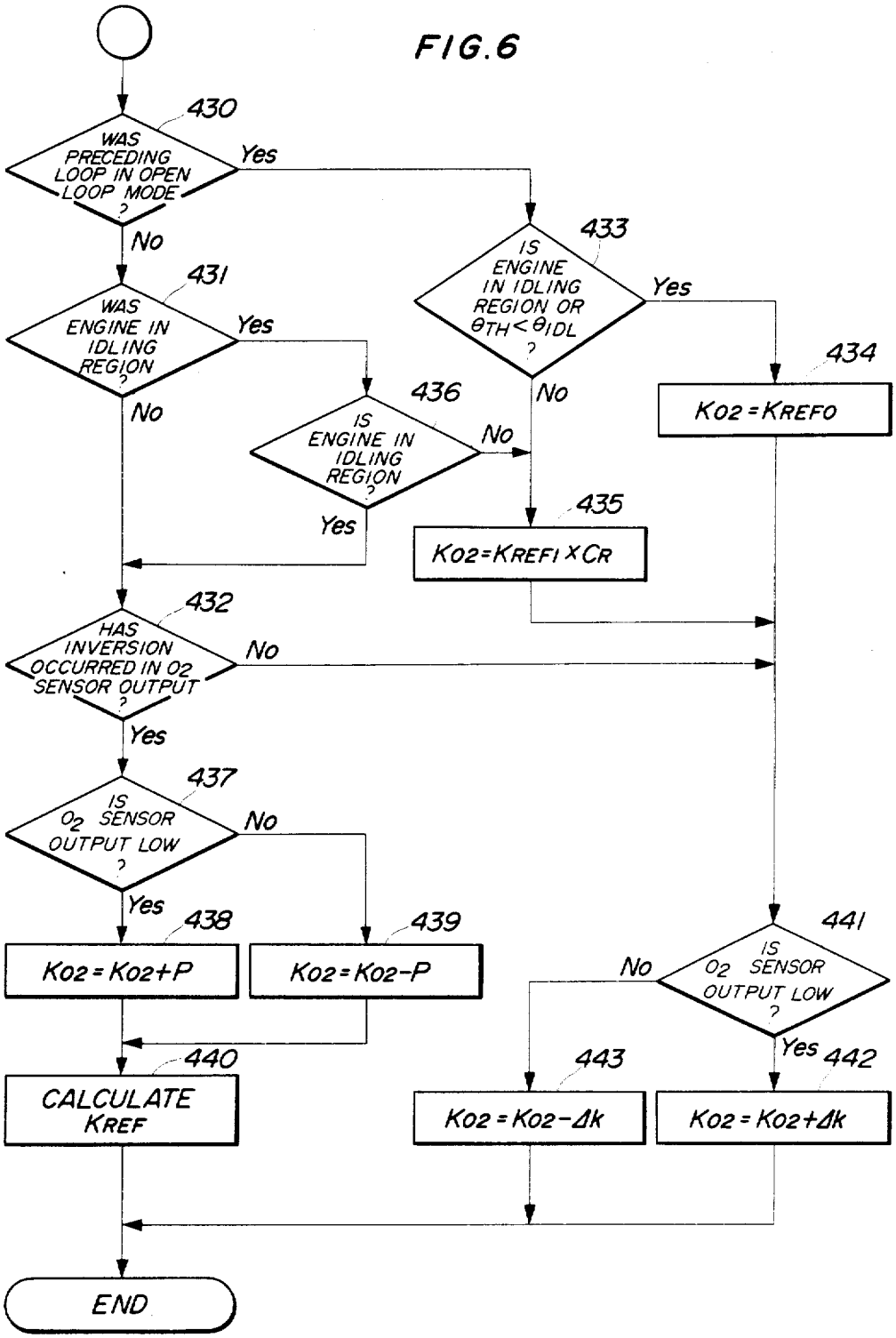
FIG. 6 is a flowchart showing in detail the step 43 in FIG. 3, in which is executed a subroutine for calculating the value of a correction coefficient $K0_2$ applied at engine operation in the air-fuel ratio feedback control effecting region.

On the other hand, if the answer to the question of the step 31 is no, that is, when the engine is operating in a region other than the idling region while at the same time the $O_2$ sensor 15 has not yet become activated, the correction coefficient $KO_2$ has its value set to a mean value KREF1, which has been calculated during the preceding feedback control effected while the engine was operating in a feedback control effecting region other than the idling region, which is indicated by the symbol II in FIG. 4, in a manner hereinafter described in detail with reference to FIG. 6, at the step 42. The correction coefficient $KO_2$ with its value set to the mean value KREF1 at the step 42 is applied at the region other than the idling region for effecting control of the air-fuel ratio in open loop mode. The same mean value KREF1 is also employed as an initial value of the correction coefficient $KO_2$ at the start of feedback mode control in the feedback control region (the region II in FIG. 4) immediately following engine operation in another region. In this way, at the start of feedback mode control in each of the idling region I and the feedback control region II, the correction coefficient $KO_2$ is set to a mean value which has been calculated in the respective one of the regions, in a manner hereinafter described in detail.

If the answer to the question at the step 30 is yes, that is, when the $O_2$ sensor has completed activation, a determination is made, at the step 32, as to whether or not the engine cooling water temperature TW is lower than a predetermined value $TWO_2$, e.g. 70° C. When the answer is yes, the program proceeds to the step 31, while when the answer is no, the step 33 is executed.

The reason for the determination as to the engine water temperature TW at the step 32 is as follows: When the temperature TW of the engine cooling water is lower than the above predetermined value $TWO_2$, the air-fuel ratio of the mixture should not be controlled in feedback mode even with the $O_2$ sensor activated, but in open loop mode, so as to promptly warm up the engine.

If the answer to the question at the step 32 is no, it is determined whether or not the fuel injection period TOUT is longer than a predetermined time period TWOT, at the step 33. This determination is made to determine whether or not the engine is operating in a wide-open-throttle region indicated by the symbol III in FIG. 4. If the answer is yes, the program proceeds to the step 41 to set the correction coefficient $KO_2$ to a value of 1.0, whereby the air-fuel ratio is controlled in open loop mode using the same coefficient set to 1.0, while if the answer is no, it is determined at the step 34 whether or not the engine is operating in a low engine speed open loop control region indicated by the symbol IV in FIG. 4, wherein the engine speed Ne is lower than a predetermined value NLOP. If the answer is yes, the program proceeds to the step 35 wherein it is determined whether or not the engine is operating in the idling region, while if the answer is no, the program proceeds to the step 36. If the answer to the step 35 is yes, the program proceeds to the aforementioned step 40 wherein the correction coefficient has its value set to the mean value KREF0. On the other hand, if the answer is no, the program proceeds to the aforementioned step 42 wherein the correction coefficient has its value set to the mean value KREF1.

At the step 36, it is determined whether or not the engine is operating in a high engine speed open loop control region indicated by the symbol V in FIG. 4, wherein the engine speed Ne is higher than a predetermined value NHOP. If the answer is yes, the program proceeds to the aforementioned step 42, while if the answer is no, it is determined, at the step 37, whether or not the value of the mixture-leaning correction coefficient KLS is smaller than 1 (i.e. $KLS < 1$), in other words, whether or not the engine is operating in a mixture-leaning region indicated by the symbol VI in FIG. 4.

If the answer to the question at the step 37 is yes, the step 42 is executed to set the value of the coefficient $KO_2$ to the aforementioned value KREF1. On the other hand, if the answer is no, it is determined, at the step 38, whether or not the engine is operating in a fuel-cut effecting region indicated by the symbol VII in FIG. 4. At this step 38, the engine is determined to be operating in the fuel-cut effecting region, if the throttle valve opening $\theta$TH shows a substantially fully closed position, when the engine speed Ne is lower than a predetermined value NFC, or if the intake pipe absolute pressure PBA is lower than a predetermined value PBAFCj which is set to larger values as the engine speed Ne increases, when the engine speed Ne is higher than the predetermined value NFC. If the determination at the step 38 provides an affirmative answer (yes), that is, when the engine is operating in the fuel-cut effecting region, the program proceeds to the aforementioned step 42 to set the value of the correction coefficient $KO_2$ to the mean value KREF1. If the answer is no, it is judged that the engine is operating in the air-fuel ratio feedback control region indicated by the symbol II in FIG. 4, wherein the air-fuel ratio of the mixture is controlled in response to the output of the $O_2$ sensor 15. As stated before, in this region, calculations are made of the value of the air-fuel ratio correction coefficient $KO_2$ and the mean value KREF1 thereof, at the step 43.

In this manner, the engine is determined to be operating in the air-fuel ratio feedback control effecting region when all the determinations at the steps 33 through 38 provide answers satisfying the feedback control condition after the completion of activation of the $O_2$ sensor 15.

Calculation of the correction coefficient $KO_2$ at the step 43 in FIG. 3 is carried out in a manner shown in the flow chart of FIG. 6.

First, it is determined whether or not the preceding loop was executed in open loop mode, at the step 430. If the answer is no, a determination is made as to whether or not the engine was operating in the idling region in the preceding loop, at the step 431. If the answer to the question at the step 431 is no, the program proceeds to the step 432 to determine whether or not the output of the $O_2$ sensor 15 has been inverted between the preceding loop and the present loop.

If the answer to the question at the step 430 is yes, that is, when the preceding loop was executed in open loop mode, it is determined, at the step 433, whether or not the engine is operating in the idling region in the present loop, i.e. whether or not the throttle valve opening $\theta$th is smaller than a predetermined idling value $\theta$IDL. If the answer is yes, the correction coefficient $KO_2$ has its value set to the mean value KREF0 at the step 434, and then the newly set coefficient $KO_2$ value is employed as an initial value in the following integral control which is executed at the steps 441 et seq.

If the answer to the question at the step 433 is no, the correction coefficient $KO_2$ has its value set to a value KREF1. CR, hereinafter referred to, at the step 435, and then the integral control is effected at the steps 441 et seq., using the thus set coefficient $KO_2$ value as an initial value. The value KREF1 is the mean value of the correction coefficient $KO_2$ applied during operation of the engine in a feedback control effecting region other than idling region, as mentioned above. The value CR is set at such a value that the overall emission characteristics of the engine are improved, depending upon the inherent emission characteristics of the engine per se, the exhaust gas purifying characteristics of the exhaust gas purifying device, etc. More specifically, if it is intended to reduce the amount of exhaust gas ingredient NOx, for instance, the value CR is set at a value larger than 1.0 so that the air-fuel ratio of the mixture, which is controlled by the correction coefficient $KO_2$ value, assumes a value richer than the theoretical ratio without fail. On the other hand, if it is intended to reduce the amounts of ingredients CO, UHC in the exhaust gases, the value CR is set at a value smaller than 1.0 so that the resulting air-fuel ratio becomes leaner than the theoretical ratio without fail. Further, when the engine temperature is low, the value CR is set at a value larger than 1.0, so as to improve the driveability of the engine at the start of the air-fuel ratio feedback control.

If the answer to the question at the step 431 is yes, that is, when the engine was operating in the idling region in the preceding loop, it is determined at the step 436 whether or not the engine is operating in the idling region in the present loop. If the answer is yes, the program proceeds to the aforementioned step 432, while if the answer is no, the aforementioned step 435 is executed. That is, when the operating condition of the engine changes between the feedback control effecting regions, such that it changes from the idling region, i.e. the region indicated by the symbol I in FIG. 4, to the feedback control region, i.e. the region indicated by the symbol II in FIG. 4, the initial value of the coefficient $KO_2$ is set to a value equal to the product of the mean value KREF1 and the value CR, at the start of the air-fuel ratio feedback control.

If the answer to the question at the step 432 is no, the program executes the aforementioned steps 441 et seq. to effect the integral control, whereas if the answer to the question at the step 432 is yes, proportional control or P-term control of the correction coefficient $KO_2$ is carried out in the following steps. That is, first at the step 437, a determination is made as to whether or not the output of the $O_2$ sensor has a lower level with respect to a reference value. If the answer is yes, a correction value P is added to the value of the correction coefficient $KO_2$, at the step 438. If the answer to the question at the step 437 is no, a correction value P is subtracted from the value of the correction coefficient $KO_2$, at the step 439. Thus, the correction value P is added to or subtracted from the value of the correction coefficient $KO_2$ upon inversion of the output of the $O_2$ sensor, in a direction of compensating for compensation for the inversion of the $O_2$ sensor output. The step 440 follows the execution of the step 438 or the step 439.

At the step 440, the mean value KREF is calculated from values of the correction coefficient $KO_2$ thus obtained, by the use of an equation (2) given below, and the calculated KREF value is stored into a memory within the ECU 5. Although this calculation is actually made with respect to each of the mean values KREF0, and KREF2 for the respective feedback control effecting regions I, II, the mean values KREF0, KREF1 are represented by KREF in the equation (2) for simplification:

$$KREF = KO_2P \times (CREF/A) + KREF' \times (A - CREF) / A \quad (2)$$

where $KO_2P$ represents a value of the coefficient $KO_2$ obtained immediately after execution of the P-term control, A a constant, CREF a variable experimentally obtained, which is set at an appropriate value between 1 and A, and KREF' a mean value of values of the correction coefficient $KO_2$ obtained so far through past operation of the engine, respectively.

Since the ratio between the values of $KO_2P$ and KREF' assumed in each execution of the P-term control is dependent on the variable CREF, it is possible to obtain a most appropriate KREF value by setting the CREF value at such a value between 1 and A that best suits the type of an air-fuel ratio feedback control system, an engine, etc, to be applied.

The integral control of the steps 441 et seq. is carried out as follows: First, at the step 441, it is determined whether or not the output of the $O_2$ sensor 15 has a lower level with respect to the reference value. When the answer to the question of the step 441 is yes, that is, when the output of the $O_2$ sensor 15 has such low level, a predetermined value $\Delta k$ is added to the value of the coefficient $KO_2$, at the step 442, while if the answer is no, the predetermined value $\Delta k$ is subtracted from the value of the coefficient $KO_2$, at the step 443, followed by termination of execution of the present loop of the program. In this manner, when the output of the $O_2$ sensor 15 maintains a lower level or a higher level with respect to the reference value, the predetermined value $\Delta k$ is added to or subtracted from the correction coefficient $KO_2$ value so as to compensate for the low or high level of the output of the $O_2$ sensor 15.

Then, the value of the correction coefficient $KO_2$ determined as above is used to calculate the fuel injection period TOUT of the fuel injection valves 6, according to the aforementioned equation (1).

What is claimed is:

1. A method of effecting feedback control of the air-fuel ratio of an air-fuel mixture being supplied to an internal combustion engine having an exhaust pipe and an exhaust gas ingredient concentration detecting means arranged in said exhaust pipe, by correcting a basic fuel supply quantity by the use of a coefficient variable in value in response to the output of said exhaust gas ingredient concentration detecting means, while said engine is operating in a predetermined air-fuel ratio feedback control effecting region, the method comprising the steps of: (1) previously dividing said predetermined air-fuel ratio feedback control effecting region into at least first and second subdivided regions; (2) determining whether or not said engine is operating in one of said first and second subdivided regions; (3) calculating and storing a first mean value of values of said coefficient which have been applied in the feedback control effected when said engine is operating in said first subdivided region, while calculating and storing a second mean value of values of the coefficient which have been applied in the feedback control effected when said engine is operating in said second subdivided region; (4) initiating the air-fuel ratio feedback control by using said first mean value as an initial value of said coefficient, when it is detected that the operation of said engine has entered said first subdivided region; and (5) initiating the air-fuel ratio feedback control by using said second mean value as an initial value of said coefficient, when it is detected that the operation of said engine has entered said second subdivided region.

2. A method as claimed in claim 1, wherein one of said first and second subdivided regions is an idling region of the operation of said engine.

* * * * *